United States Patent [19]
Higgins
[11] 4,418,960
[45] * Dec. 6, 1983

[54] MULTIPLE-BED SOLUTION MINING OF AN INCLINED STRUCTURE

[75] Inventor: Rudolph S. Higgins, Moab, Utah

[73] Assignee: Texasgulf Inc., Stamford, Conn.

[ * ] Notice: The portion of the term of this patent subsequent to Oct. 25, 2000 has been disclaimed.

[21] Appl. No.: 318,102

[22] Filed: Nov. 4, 1981

[51] Int. Cl.[3] ..... E21B 43/28
[52] U.S. Cl. ..... 299/5
[58] Field of Search ..... 299/4, 5

[56] References Cited

U.S. PATENT DOCUMENTS 3,510,167 5/1970 Carmody ..... 299/4
4,290,650 9/1981 Thompson ..... 299/4

*Primary Examiner*—Ernest R. Purser
*Attorney, Agent, or Firm*—Denis A. Polyn

[57] ABSTRACT

Solution mining method particularly adapted for recovery of potash and the like from multiple beds of relatively thin, inclined strata at substantial depths. Dissolution of each ore strata overlain by an insoluble and impermeable strata takes place through a single borehole in sequential order beginning with the deepest ore strata. Water is injected down a borehole at a predetermined rate and, being much less dense than present brine, flows in an updip direction along the top of the cavity to the forward mining face remote from the drill hole. Loaded, heavy brine flows downdip along the bottom of the cavity to an outflow pipe communicating with the bottom of the cavity.

5 Claims, 6 Drawing Figures

MULTIPLE-BED SOLUTION MINING OF AN INCLINED STRUCTURE

SUMMARY OF THE INVENTION

The invention relates to the mining of soluble minerals from inclined underground strata, and particularly to the solution mining of sylvinite for the recovery of potassium chloride from sylvinite by a method of solution mining multiple beds of soluble materials located within inclined strata at substantial depths.

The rich but thin sylvinite deposits in the Paradox Basin of southeast Utah are particularly adapted to the method of the present invention. Each mineral zone of interest relating to the invention is overlain by an insoluble and impermeable layer of strata. The insoluble strata provides a layer preventing vertical dissolution of overlying salt halite strata. This makes it possible, using the present invention, to solution mine several of the sylvinite zones through one well, thus rendering the economics of an operation more favorable.

The invention comprises establishing a cased borehole communicating with the ore strata of interest. The first solution mining cavity is developed in the deepest ore stratum penetrated by the borehole. It comprises injecting water into the borehole such that the area of dissolution, i.e. the active mining face, moves upwardly just under the insoluble stratum in the updip direction and away from the borehole. The incoming water, being much less dense than brine present in the cavity, flows in the updip direction along the top of the cavity insuring that the fresh water is rapidly and continuously delivered to the active mining face in the cavity. Loaded, heavy brine flows downdip along the bottom of the cavity from where it is extracted. When the deepest ore stratum is depleted of recoverable ore, the borehole is plugged back up to the next deepest ore stratum of interest. The borehole casing is then perforated or cut away and tubing situated inside the casing so that the second solution mining cavity can be developed. When the second ore stratum is depleted of recoverable ore, the above mentioned sequence is repeated again for each succeeding ore stratum of interest until all ore strata of interest have been mined.

A more complete understanding of the invention may be obtained from the accompanying drawings.

DESCRIPTION OF THE PREFERRED EMBODIMENT

Figure 1:
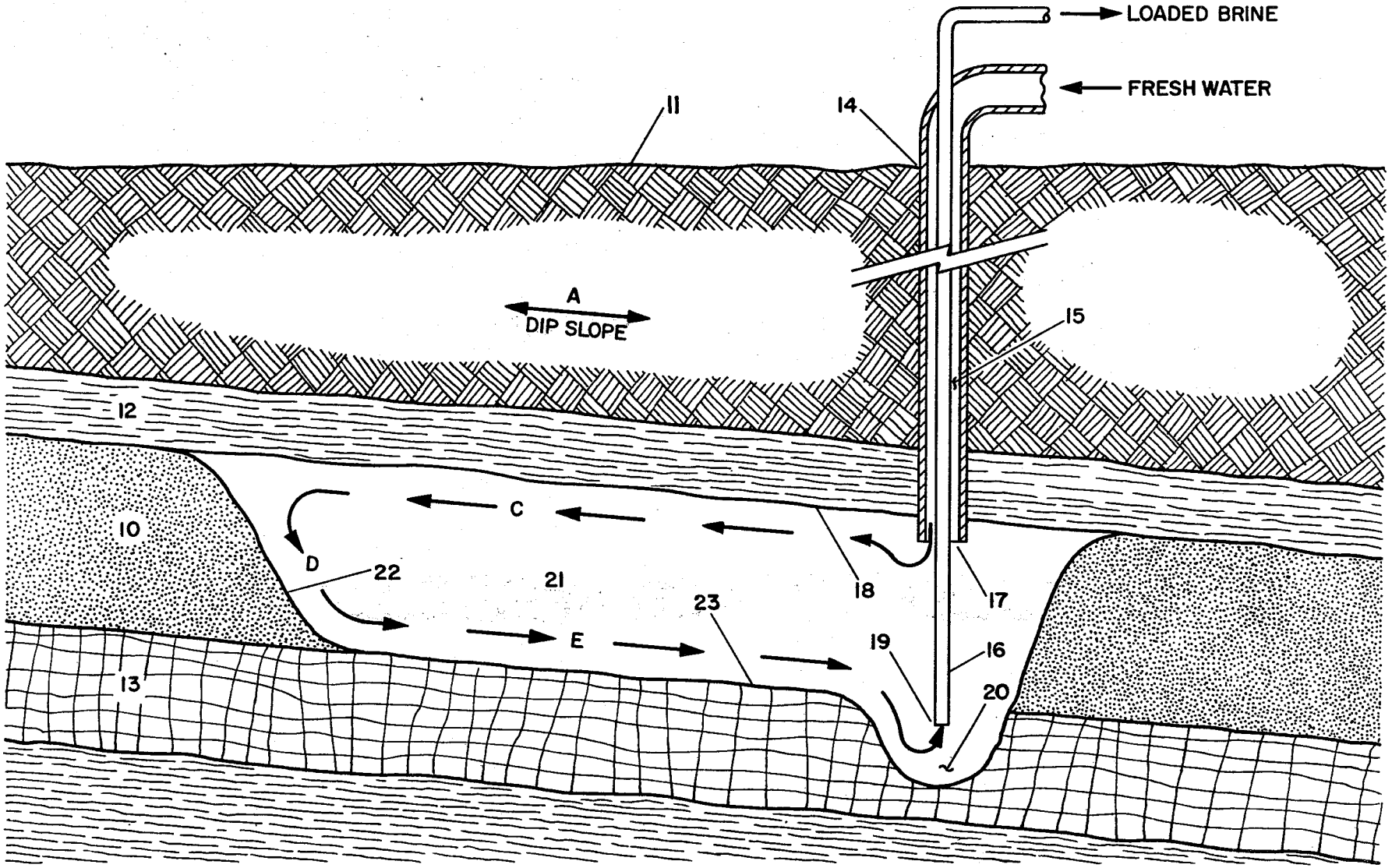
FIG. 1 is a schematic diagram in profile of a cavity being developed in the lowermost ore stratum according to the methods of the present invention.

Referring to the drawings, a typical inclined ore formation is shown to which the method of the present invention is particularly adapted. The formation shown is exemplary of the saline deposits of the Paradox Basin in southeast Utah.

The present invention, as will be described more fully below, takes advantage of this inclined orientation and insoluble zoning to develop an effective and efficient mining system, even in spite of the fact that some of the mineralization of interest is below 7,000 feet.

As indicated in the drawings, the primary salt of interest is sylvinite (KCl.NaCl), although other water soluble salts are recoverable by the invention also.

In the formation shown in FIG. 1, the lowermost extractable ore layer 10 is located at a depth below ground level 11 and slopes upwardly in the dip direction, i.e. from right to left as viewed in the drawings, and as indicated by Arrow A. The strike direction, i.e. at a right angle to the dip direction, is indicated by Arrow B in FIG. 2.

Within a few feet of the ore zone 10 is an impermeable clastic layer 12 of shale, dolomite, anhydrite or the like, and immediately below the ore layer 10 is a salt layer 13 (NaCl). The layer of salt 13 below the ore layer is not critical to the patented process.

The drill hole extends vertically downward from ground level and initially through ore layer 10 and partially into the underlying salt layer to form a sump 20 for the effluent, as will be described hereinafter. Fresh water pipe 14 extends down borehole and terminates at its lower end 17 near the upper portion or top of ore layer 10. Exit pipe 16 is concentrically disposed within inlet water pipe 14 and extends downwardly to a terminal point 19 adjacent to the sump 20 in salt layer 13.

Figure 2:
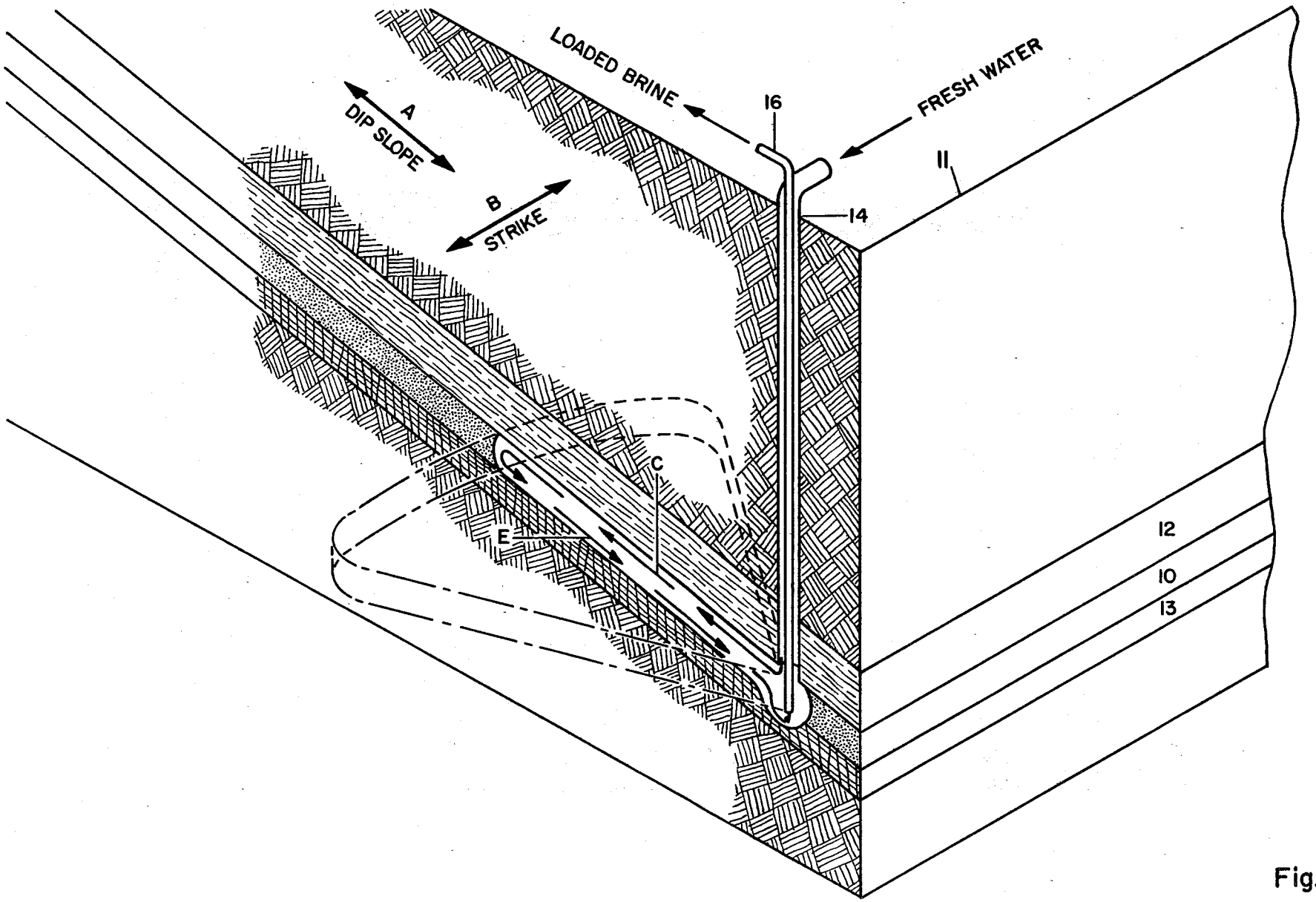
FIG. 2 is an isometric schematic diagram consistent with FIG. 1.

In operation fresh water is injected into the mining cavity 21 through the annular space 15 and is discharged and flows along the top 18 of the cavity 21 in the direction of Arrow C, i.e. upwardly in the dip direction, into contact with and outwardly and downwardly along the active mining face 22 as indicated by Arrow D and shown in FIG. 1. As shown in FIG. 2, the dissolution area or mining face 22 may form a widening arc updip from the drill hole 14. The loaded brine flows downdip along the top 23 of the underlying salt layer 13 in the direction of arrows, into sump 20 and then exits through discharge pipe 16 for further extractive processing by conventional methods such as solar evaporation, standard evaporative crystallizers, etc.

Figure 3:
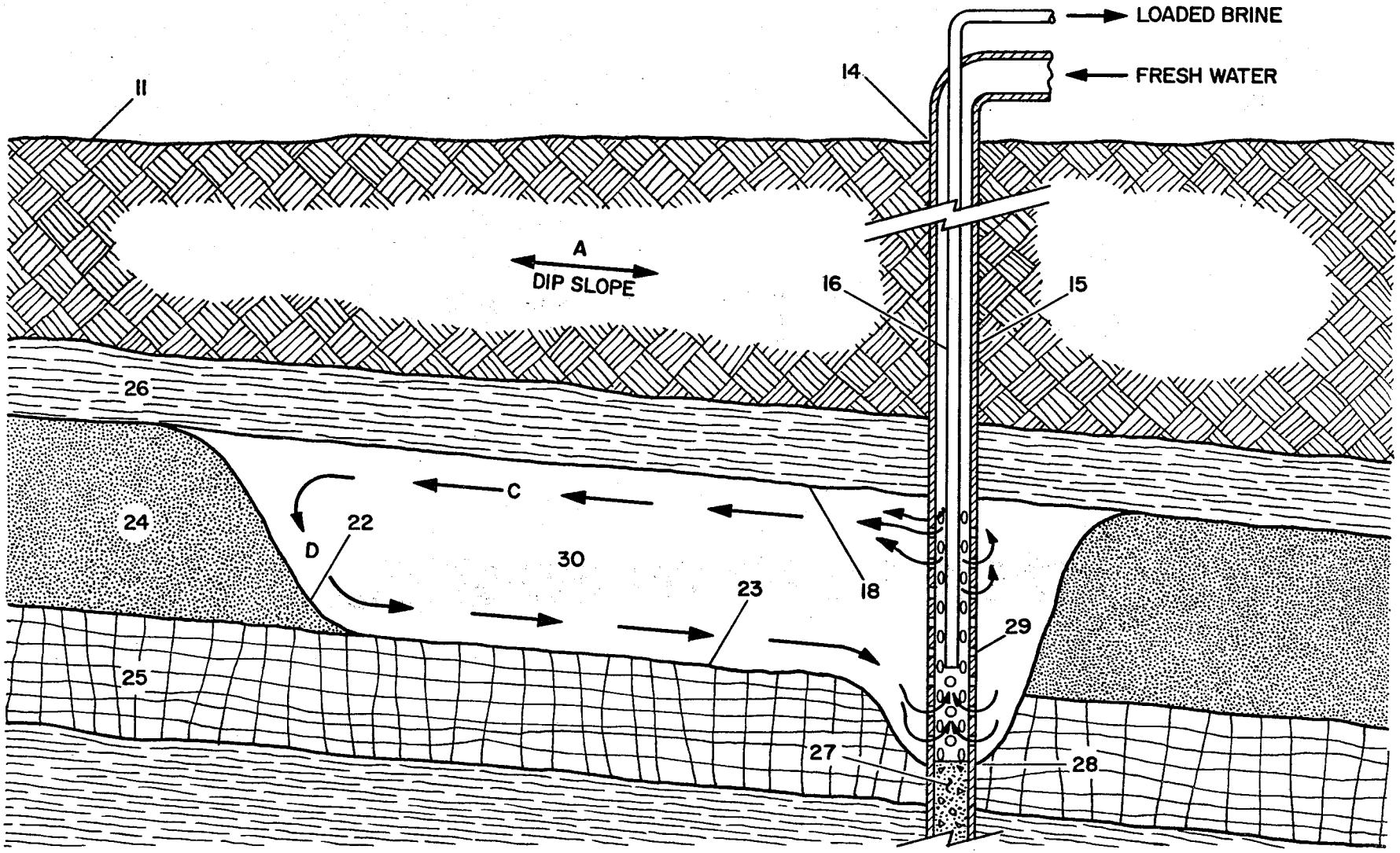
FIG. 3 is a schematic diagram consistent with FIG. 1 showing a cavity being developed in an ore stratum other than the lowermost ore stratum.

After the lowermost ore zone 10 is depleted of recoverable ore, exit pipe 16 is pulled out of the inlet water pipe 14. The inlet water pipe 14 is plugged with cement or other suitable material 27 up into salt layer 25 to level 28 which is just below the next vertically disposed ore zone 24 of interest as shown in FIG.3. Ore stratum 24 is the next deepest ore zone of interest diposed some vertical distance above the clastic 12 of the deepest ore zone 10. Ore zone or layer 24 is similar to ore zone 10 previously described with an impermeable layer 26 within a few feet above and salt layer 25 immediately below the ore layer. The layer of salt 25 below the ore layer is not critical to the patented process.

The inlet water pipe 14 has perforations 29 or is cut away by methods presently known. Perforations are made as shown in the inlet water pipe 14, beginning near the upper portion of top 18 of ore layer 24 and extending partially into the underlying salt layer to form a sump 28. Exit pipe 16 is concentrically redisposed within inlet water pipe 14 and extended downwardly to a terminal point adjacent to the sump 28 in salt layer in similar manner as previously described.

Fresh water is injected down the annular space 15 and is discharged into cavity 30 through the upper perforations in pipe 15 at the top 18 of cavity 30. Cavity 30 is developed in ore zone 24 in same manner as was previously described. The loaded brine in sump 28 exits through the lower perforations in pipe 14 to discharge pipe 16. The fresh water being less dense than the brine present in the cavity is caused to flow out the upper perforations in pipe 14. Likewise the more dense saturated brine migrates to the lowest area of cavity 30, and enters exit pipe 16 from sump 28 through the lower perforations in pipe 14.

When ore zone 24 is depleted of recoverable ore, the next vertically disposed ore stratum of interest is solution mined in the same manner as heretofore described. Each succeeding vertically disposed ore stratum of interest is solution mined as heretofore described until all ore strata of interest have been solution mined.

Figure 4:
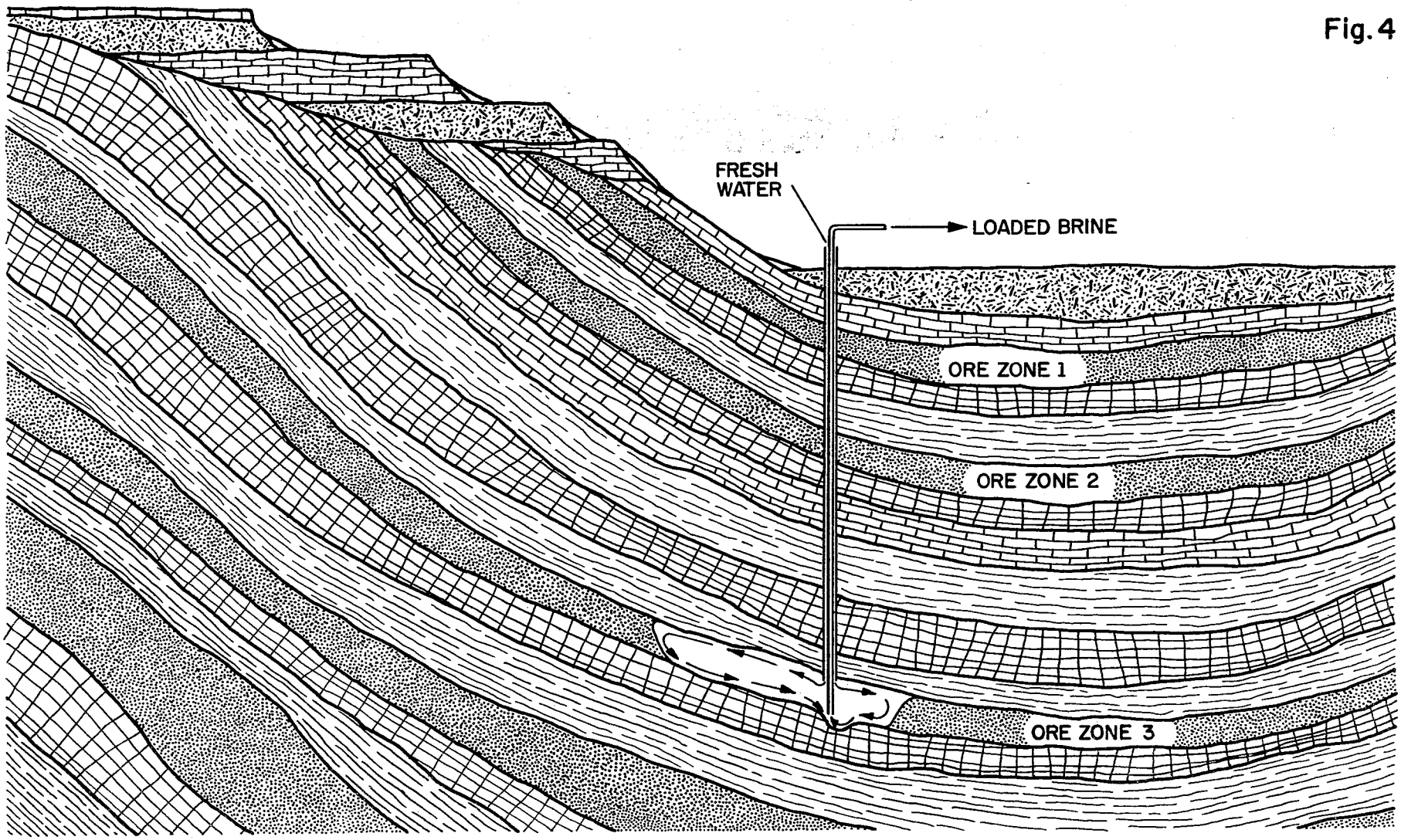
FIGS. 4, 5 and 6 are schematic diagrams showing an overall view consistent with FIG. 1 with the system operated in a multi-ore bed operation.
Figure 5:
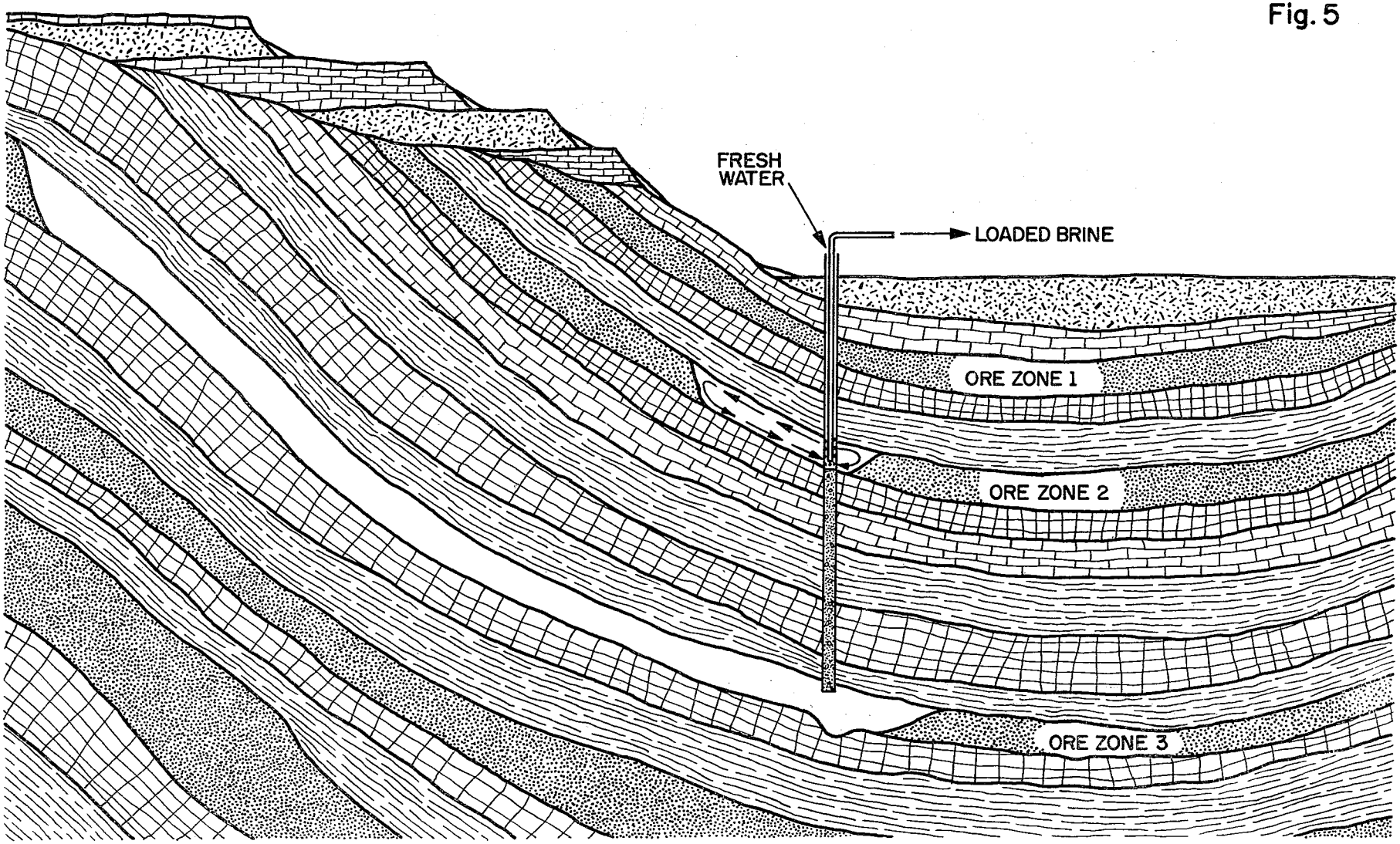
Figure 6:
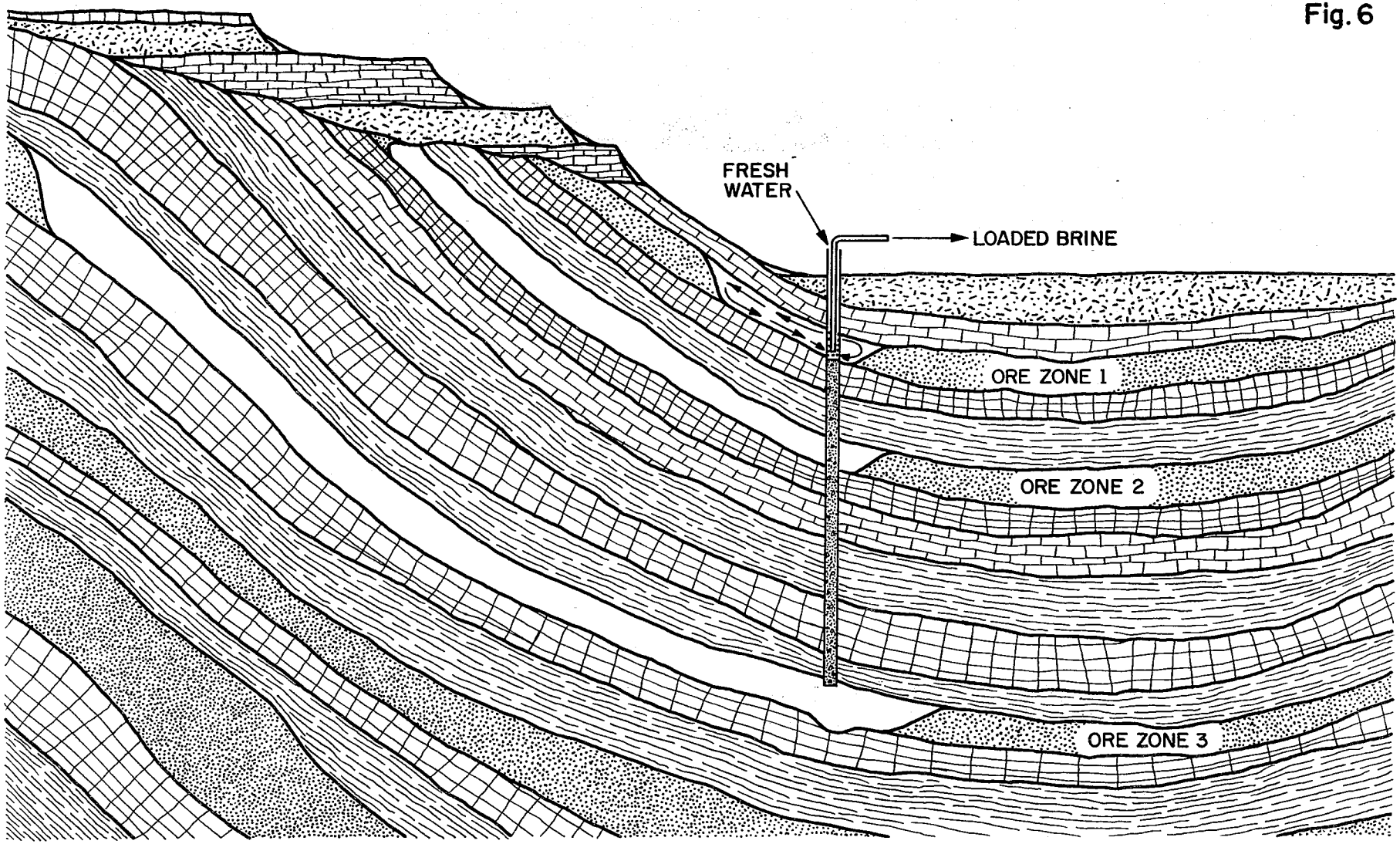

In FIG. 4, 5 and 6, the lowermost ore body, in this case ore 3 in FIG. 4, is in the process of being extracted. In FIG. 5, ore 3 has been totally extracted, and ore 2 is in the process of being extracted. In FIG. 6, ore 3 and ore 2 have been completely extracted, and ore 1 is in the process of being extracted.

Although not shown in drawings, any number of initial wells can be developed along the base or side of an inclined structure. The number depends on the mining plan and economic factors.

The thickness and composition of the stratum extracted controls or determines the injection and extraction rate of the solute.

Normally, the method of the invention will operate at ambient or formation temperature, although heat may be added if desired.

The KCl content of sylvinite mineral zones mined will usually be above about 15% KCl, although there is no upper or lower limit of enrichment that may be mined with the present process.

While one embodiment of the present invention has been shown and described herein, it is to be understood that certain changes and/or additions may be made thereto by those skilled in the art without departing from the scope and spirit of the invention.

I claim:

1. A method of solution mining multiple beds of an extractable ore disposed in sloping subterranean strata each disposed beneath an insoluble stratum which comprises the steps of:

(a) establishing a borehole communicating with said strata at a downdip location therein;

(b) commencing with the lowermost ore zone, injecting solvent into said borehole in such a manner that the solvent will be directed in an updip direction along the upper portion of said stratum to develop a cavity with mining face remote from said borehole;

(c) withdrawing solvent with dissolved ore through said borehole at an exit point disposed vertically downwardly from the entrance point at which the incoming solvent is discharged into the cavity from the borehole;

(d) adjusting such withdrawal to provide for downflow of the solvent across said mining face and downwardly in a downdip direction along the floor of said cavity to said exit point at a rate sufficient to extract said ore stratum without appreciable mining of vertically adjacent strata;

(e) after the lowermost ore zone is depleted of recoverable ore, the center extraction pipe is raised, the said borehole is plugged up to the next vertically disposed ore stratum of interest, the casing is perforated or cut away in the said next ore zone, the said extraction pipe is then lowered to a level slightly below the said next ore zone to form a sump;

(f) the said next ore stratum is mined by developing a new cavity in said manner as heretofore described in Steps (b) through (d); and, (d) each succeeding vertically disposed ore stratum of interest is mined in said manner as heretofore described in Steps (b) through (f).

2. In the method of claim 1, said solvent being water or a solution unsaturated in at least one salt at the temperature of the cavity.

3. In the method of claim 2, said ore being rich in at least one soluble salt selected from the group consisting of sodium, calcium, magnesium, and potassium salts.

4. In the method of claim 2, said ore being rich in sylvinite.

5. In the method of claim 1, said injection into borehole being adjusted to form elongated cavities in said ore strata to provide continued stability in the cavities thus greatly extending the life of the system.

* * * * *